US006747199B2

(12) United States Patent
Shah

(10) Patent No.: US 6,747,199 B2
(45) Date of Patent: Jun. 8, 2004

(54) QUICK RELEASE DRUM LUG ASSEMBLY

(76) Inventor: Devang Shah, 20 Rolling Hill Rd., Old Westbury, NY (US) 11568

( * ) Notice: Subject to any disclaimer, the term of this patent is extended or adjusted under 35 U.S.C. 154(b) by 0 days.

(21) Appl. No.: 10/067,571

(22) Filed: Feb. 6, 2002

(65) Prior Publication Data

US 2002/0104427 A1 Aug. 8, 2002

Related U.S. Application Data

(60) Provisional application No. 60/266,887, filed on Feb. 6, 2001.

(51) Int. Cl.[7] ..... G10D 13/02
(52) U.S. Cl. ..... 84/411 R; 84/413; 84/411 A
(58) Field of Search ..... 84/411 R, 413, 84/411 A

(56) References Cited

U.S. PATENT DOCUMENTS

| | | | | |
|---|---|---|---|---|
| 3,533,324 A | | 10/1970 | Price | 84/411 |
| 4,475,434 A | | 10/1984 | Willis | 84/411 |
| 4,506,586 A | | 3/1985 | Brewer | 84/413 |
| 4,583,442 A | | 4/1986 | Minor | 84/413 |
| 4,694,726 A | * | 9/1987 | Silvestri | 84/413 |
| 6,365,811 B1 | * | 4/2002 | Conta | 84/411 R |

* cited by examiner

*Primary Examiner*—Shih-Yung Hsieh

(57) ABSTRACT

A quick release lug system for musical drums. The assembly utilized by the present invention uniquely allows a user to remove a drumhead quickly, dispensing with the need to unscrew multiple tuning rodes. Thus, the assembly of the present invention allows for more efficient transport, assembly and disassembly of drums than previously available, and does so in a manner that maintains the integrity of the traditional tuning system.

8 Claims, 2 Drawing Sheets

QUICK RELEASE DRUM LUG ASSEMBLY

This Application relates to Provisional Application No. 60/266,887, filed by the present Applicant on Feb. 6, 2001.

BACKGROUND OF THE INVENTION

1. Field of the Invention

The present invention is a quick release lug system for musical drums. The assembly utilized by the present invention uniquely allows a user to remove a drumhead quickly, dispensing with the need to unscrew multiple tuning rods. Thus, the assembly of the present invention allows for more efficient transport, assembly and disassembly of drums than previously available, and does so in a manner that maintains the integrity of the traditional tuning system.

2. Description of the Prior Art

Numerous innovations for drum lug assemblies have been provided in the prior art that are described as follows. Even though these innovations may be suitable for the specific individual purposes to which they address, they differ from the present invention as hereinafter contrasted. The following is a summary of those prior art patents most relevant to the invention at hand, as well a description outlining the differences between the features of the present invention and those of the prior art.

1. U.S. Pat. No. 4,583,442, invented by Minor, entitled "Drum Latch Assembly"

The patent to Minor describes a tunable quick release mechanism for securing at least one drum head to a drum shell in an aesthetically pleasing manner. The mechanism may be used with a drum having either one drum head or two drum heads. An anchor affixed to the drum shell is connected to grip by means of lever. A pivoting lug fitted within retaining grooves formed within the grip is connected to means to clamp the drum head to the drum shell. Spring means may be used to secure the pivoting lug within the retaining grooves.

2. U.S. Pat. No. 3,533,324, invented by Price, entitled "Quickly Removable Drum Head"

The Price invention describes a rapid change drum head for a musical drum characterized by six or eight toggle locking assemblies. Each locking assembly includes a bracket mounted to the side of the drum shell, and a toggle lock attached to the drum rim by a tensioning rod. A lever hingedly connected to the tensioning rod has a free end which can abuttingly engage a protruding portion of the bracket to draw the drum rim downward upon movement of the lever into a closed position.

3. U.S. Pat. No. 4,475,434, invented by Willis, entitled "Quick Release Drum Head Assembly"

The Willis invention describes a quick release drum head assembly having a flange over which the drum head is placed the flange including means to tension the drum head and secure the drum head assembly to a drum shell. Also disclosed is a constant height rim section assembly to fix the distance from the rim to the drum head regardless of the degree of tensioning of the drum head.

4. U.S. Pat. No. 4,506,586, invented by Brewer, entitled "Quick Release Drum Head Restraint"

In the patent to Brewer, a quick release drum head restraint for a musical drum. The restraint consists of a pendulum unit and a toggle unit which enable the user to quickly remove and replace a drum head without significantly altering the tuning of the drum head. The pendulum unit includes a tension rod fastened at one end to the rim head and at the other end to a cylindrical pendulum which includes a bushing located at its center. The cylindrical pendulum fits inside the toggle unit and the bushing slides on an inclined plane or ramp within the toggle unit. The toggle units swivels or pivots at a pivot point to engage the cylindrical pendulum and enable the bushing to roll along the ramp. Thus, the drum head can be quickly removed by pivoting the toggle unit to release the pendulum unit and the new drum head can be installed by reinserting the pendulum unit in the toggle unit. Replacement of the drum head does not significantly alter the tuning of the drum head.

It is suggested that the closest prior art to the present invention is U.S. Pat. No. 3,533,324, invented by Price. However, although the Price assembly is similar to the present invention in that it provides a quick release drum lug assembly, significant differences exist between the products. Most notably, as will be described and illustrated in greater detail herein, the present invention provides a unique groove and sliding mechanism that is not found in the prior art, and this configuration allows for increased stability, ease of movement of first and second lug components, and overall simplicity for manufacturing and installation purposes.

SUMMARY OF THE INVENTION

As noted, the present invention is a quick release lug system for musical drums. The assembly utilized by the present invention uniquely allows a user to remove a drumhead quickly, dispensing with the need to unscrew multiple tuning rods.

In light of the foregoing, it is generally an object of the present invention to provide an assembly that allows for more efficient transport of drum sets.

It is a further object of the invention to provide an assembly that allows for quicker and easier assembly and disassembly of drums than previously available.

It is an additional object of the invention to provide a device that performs the foregoing in a manner that maintains the integrity of the traditional tuning system.

It is also an object of the invention to provide a device that is constructed of common materials, functioning to allow the system to be produced relative ease.

It is a further object of the invention to provide a system that may be easily retrofitted to previously-existing drums.

Likewise, it is another object of the invention to provide a system that may be installed on new drums of a variety of styles, shapes, and sizes.

It is a further object of the present invention to provide an assembly that is relatively inexpensive to manufacture, produce, and distribute.

It is an additional object of the present invention to provide an assembly that may itself be manufactured in a variety of shapes and sizes, according to manufacturer and user needs.

In addition, it is an object of the present invention to provide an assembly that is itself lightweight in nature and easy for a user to transport.

Furthermore, it is an object of the present invention to provide an assembly that may include text or graphics thereon, for the purposes of enhancing the appearance of the drums on which they are utilized.

Finally, it is an object of the present invention to provide alternate embodiments of the assembly, wherein the invention is constructed of different materials and bears slightly differing configurations, according to manufacturer and user needs.

The novel features which are considered characteristic for the invention are set forth in the claims. The invention itself, both as to its construction and its method of operation, together with additional objects and advantages thereof, will be best understood from the following description of the embodiments when read and understood in connection with accompanying drawings.

BRIEF DESCRIPTION OF PREFERRED EMBODIMENTS

DETAILED DESCRIPTION OF THE PREFERRED EMBODIMENT

Figure 1:
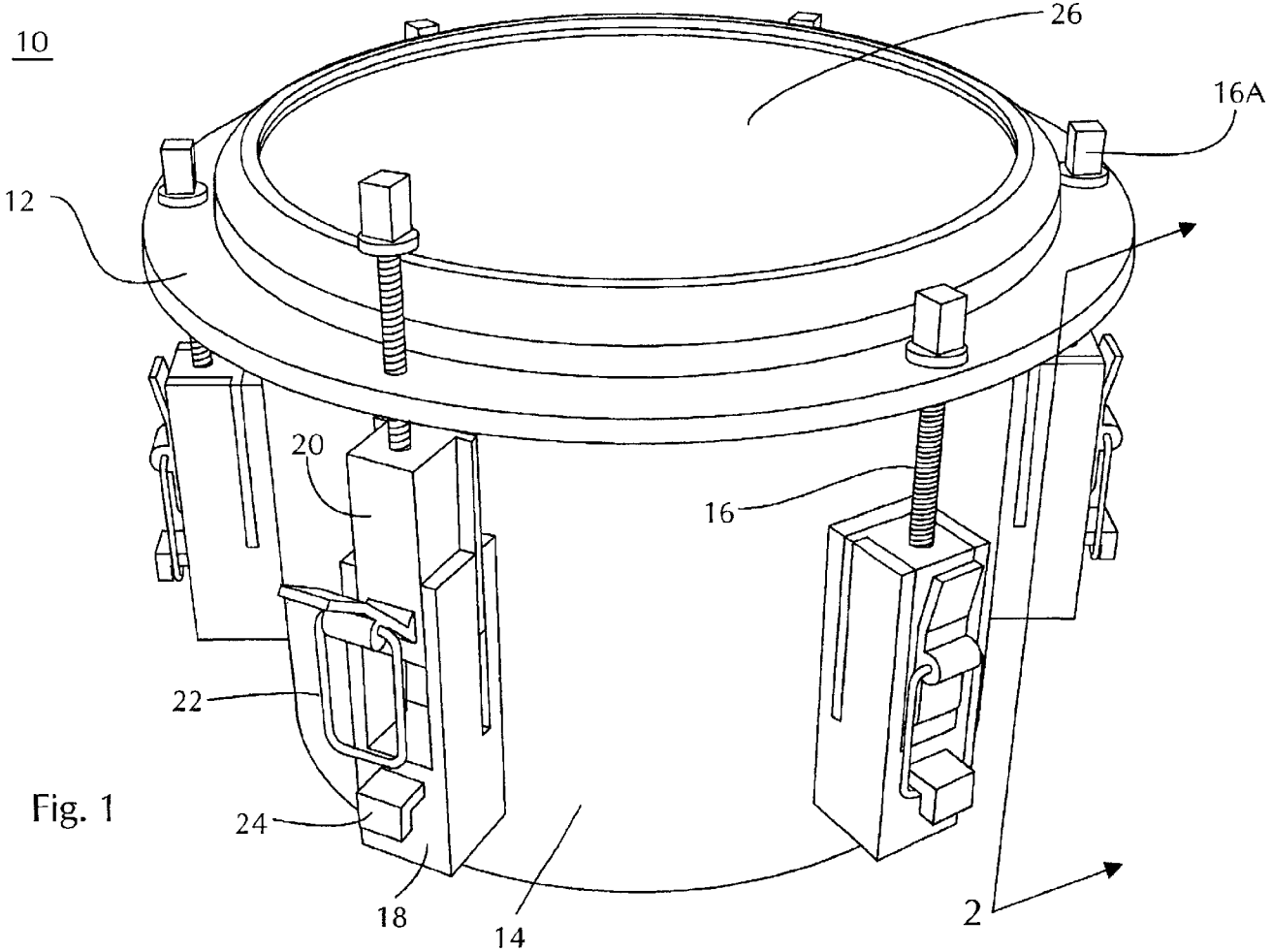
FIG. 1 is a front, three-quarter perspective view of a drum including the assembly of the present invention, shown for the purposes of example only.
Figure 2:
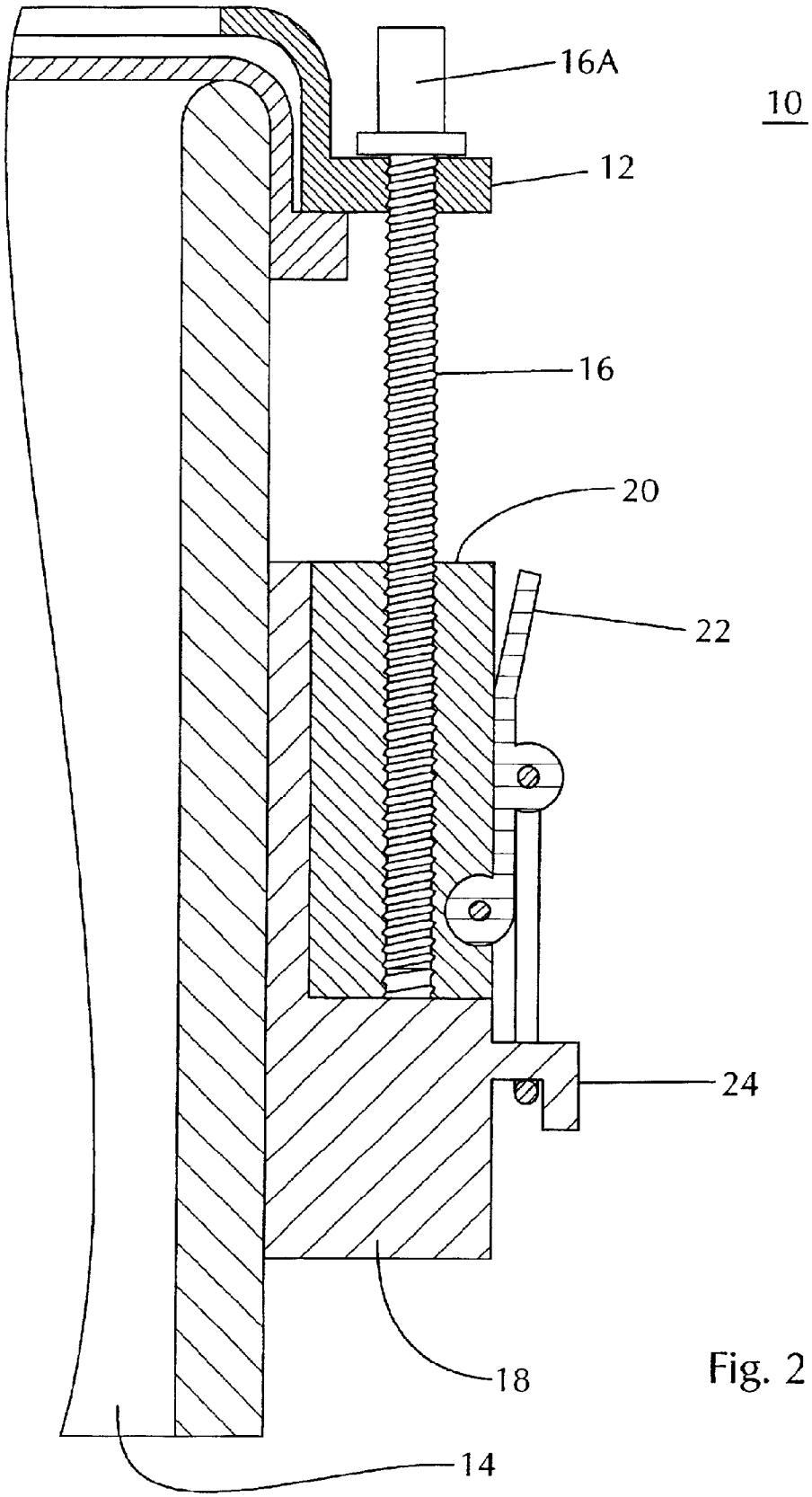
FIG. 2 is a partial cutaway view along Line "2" of the drum of FIG. 1, also illustrated for the purposes of example.

Referring to FIG. 1, which is a front, three-quarter perspective view of a drum including the assembly of the present invention, shown for the purposes of example only; and FIG. 2, which is a partial cutaway view along Line "2" of the drum of FIG. 1, also illustrated for the purposes of example: the drawings depict the drum rim (12), drum shell (14), tuning rods (16), lower lug portion (18), upper lug portion (20), latch (22), hook (24), and drumhead (26).

Generally, the drum heads and rims are the parts that are hit when playing, and the pitch of a drum is determined primarily by the tightness of the drum head. The turning of multiple tuning rods in a clockwise direction tightens the head by placing pressure upon the rim, which functions to raise the pitch when hit. Accordingly, the turning of the tuning rods in a counterclockwise direction loosens the head, functioning to lower the pitch. The tuning rods removably received by lugs, or metal members attached to the sides of the drums in question.

Thus, for the purpose of comparison to the present invention, traditional drum lugs tune the drumheads by connecting them to a tuning rod, which pulls down upon a metal counter hoop, which rests upon the top of the drumhead. The lug of the present invention, however, functions much in the manner of a traditional lug that is split in two components along the horizontal axis. An upper portion (20) comprises the tuning rod (16), threaded female counterpart to the tuning rod, and thus a first portion of the lug. The permanently attached second portion of the lug (18) appears at the base for the purposes of attachment.

Importantly, the first and second parts of the lug are removably attached by means of a latch (22) that secures to a hook (24). Such may be easily pressed to close and tighten the drumhead, resulting in a turnkey flight case latch.

To illustrate the manner in which the device functions, FIG. 1 depicts four such lug assemblies upon a typical drum, with three shown in the closed and tightened position. The left front lug assembly is shown in the open position, prior to the latch (22) engaging the hook (24) and being secured into place.

Such an assembly is intended to be used upon drums of al types, including the bass drum, large tom, snare drum, and smaller tom found in standard drum sets. The drums upon which the present invention are installed also function as storage compartments. Specifically, multiple drums are allowed to nest within each other, providing a stacking like configuration in which an entire set of drums may be easily transported from one location to another.

To better outline the capability afforded by the design, the following is a list of steps that may be utilized in the method for effective transportation: First, the user may replace the previously existing drum lugs with the quick release type lugs provided by the present invention. Second, the user may unbuckle all of the lugs in the drum kit. Next, the user can easily remove the rim or hoop as well as the drumhead itself. Previously existing devices such as muffle bags may then be placed in the open drum. As previously noted, the drums may then be conveniently nested inside one another. The user may then re-lock all of the lugs in opposing pairs, functioning to allow the user to carry several such drums in a very tightly configured array that is still protective and secure in nature.

It should also be noted that in the preferred embodiment, the quick release function of the assembly is hidden from view. This provides a series of lugs that appear the same as traditional lugs, allowing the drums to maintain their intended design.

Regarding the general versatility of the present invention, the assembly of the present invention may utilize a cross groove type mechanism or, alternatively utilize a draw hasp type mechanism to accomplish its intended purposes. The sliding action provided by the latter provides a secure and effective means that is not found in the prior art.

Specifically, as shown by both FIG. 1 and FIG. 2, the upper component (20) is slidingly received by lower component (18), as the latter is of a size and shape sufficient to provide a tight fit therefor. Such construction insures that the upper component will be placed properly by the user, and the mechanism is quite easy to work, even for those inexperienced with fasteners or lock mechanisms of this sort. The siding action may be facilitated by any means known in the art, including ball bearings and the like.

Furthermore, it should be noted that the lugs of the present invention are solid cast in steel in the preferred mode of production. Such is significant in that, unlike the traditional lugs which are hollow and trap sound to an undesirable degree, the present lugs provide a strong and durable device without such inconveniences.

In addition, in all modes of manufacture the assembly is suitable for usage in conjunction with hybrid drums. Such drums are played acoustically with traditional drumheads and then played through an amplifier by utilizing special mesh drumheads which trigger electronic sounds. Due to the unique quickness in attaching and removing the lug assembly, the present invention allows hybrid drum players to conveniently switch from traditional to mesh drumheads at any time they choose.

Thus, in total, the assembly functions to provide a great degree of benefits that are not found in the prior art. The assembly allows for a very quick change in the placing and removal of the drumhead. At the same time, the invention also provides a much needed solution to the time-consuming problem of removing every single tuning rod, and therefore uniquely functions to lock the same in place for the purposes of user convenience. The initial tuning of the drumhead is not lost when the drum is disassembled, and significant time in altering internal sound muffling is consistently saved. Although the assembly is new, the actions required in operating the same are simple, thus the same can be performed by drummers of all ages and all levels of experience.

With regards to all descriptions and graphics, while the invention has been illustrated and described as embodied, it is not intended to be limited to the details shown, since it will be understood that various omissions, modifications, substitutions and changes in the forms and details of the device illustrated and in its operation can be made by those skilled in the art without departing in any way from the spirit of the invention.

Without further analysis, the foregoing will so fully reveal the gist of the present invention that others can readily adapt it for various applications without omitting features that, from the standpoint of prior art, constitute essential characteristics of the generic or specific aspects of this invention. What is claimed as new and desired to be protected by Letters Patent is set forth in the appended claims.

What is claimed is:

1. A quick release drum lug assembly comprising:

an upper lug portion attached to a drum rim, the upper lug portion comprising at least one aperture for receiving a tuning rod therein, the tuning rod extending downwardy through an aperture within the periphery of the drum rim into the upper lug portion, the upper lug portion further comprising a latch located at a bottom portion thereof, the latch hingedly attached to the upper lug portion, a lower lug portion attached to a drum shell, the lower lug portion comprising a groove of a size and shape corresponding to the upper lug portion, functioning to allow the lower lug portion to slidingly receive the upper lug portion therein, the lower portion further comprising a hook located at a bottom portion thereof and extending outwardly therefrom, the hook function to receive the latch for securing the upper lug portion and the lower lug portion to one another when the upper lug portion slides downwardly into the groove of the lower lug portion, functioning to allow a user to remove the drumhead quickly and disassemble a drum set utilizing the assembly, for the purposes of transport of same, while maintaining tuning of the drumhead.

2. The quick release drum lug assembly as described in claim 1, wherein lug members are solid cast in steel.

3. The quick release drum lug assembly as described in claim 1, wherein the assembly utilizes a mechanism selected from the group consisting of a cross groove mechanism, a draw hasp and lever, and a flipped hasp and lever.

4. The quick release drum lug assembly as described in claim 1, wherein the assembly bears an appearance similar to that of previously existing drum lugs, functioning to maintain the intended appearance of the drum.

5. The quick release drum lug assembly as described in claim 1, wherein the assembly is utilized in conjunction with drums selected from the group consisting of a bass drum, large tom, snare drum, and smaller tom.

6. The quick release drum lug assembly as described in claim 1, wherein the assembly is utilized in connection with hybrid drums.

7. The quick release drum lug assembly as described in claim 1, wherein the assembly allows for nesting of a plurality of drums equipped with quick release drum lugs.

8. The quick release drum lug assembly as described in claim 1, wherein the assembly further utilizes an addition locking screw that functions to keep the tuning rod in a fixed position during transport.

* * * * *